US010398266B2

(12) United States Patent
Holsten

(10) Patent No.: US 10,398,266 B2
(45) Date of Patent: Sep. 3, 2019

(54) EFFICIENT VACUUM CLEANER FAN INLET

(71) Applicant: Emerson Electric Co., St. Louis, MO (US)

(72) Inventor: Stuart V. Holsten, Stover, MO (US)

(73) Assignee: Emerson Electric Co., St. Louis, MO (US)

( * ) Notice: Subject to any disclaimer, the term of this patent is extended or adjusted under 35 U.S.C. 154(b) by 251 days.

(21) Appl. No.: 14/879,207

(22) Filed: Oct. 9, 2015

(65) Prior Publication Data

US 2016/0102675 A1 Apr. 14, 2016

Related U.S. Application Data

(60) Provisional application No. 62/062,434, filed on Oct. 10, 2014.

(51) Int. Cl.

| | |
|---|---|
| ***A47L 5/22*** | (2006.01) |
| ***F04D 29/16*** | (2006.01) |
| ***F04D 29/42*** | (2006.01) |
| ***F04D 29/44*** | (2006.01) |

(52) U.S. Cl.

CPC ..... *A47L 5/22* (2013.01); *F04D 29/162* (2013.01); *F04D 29/4213* (2013.01); *F04D 29/4226* (2013.01); *F04D 29/441* (2013.01); *F05D 2250/51* (2013.01)

(58) Field of Classification Search

CPC ..... A47L 5/22; F04D 29/162; F04D 29/4213; F04D 29/4226; F04D 29/441; F04D 29/403; F04D 29/26; F04D 29/06; F04D 29/701; F05D 2250/51

See application file for complete search history.

(56) References Cited

U.S. PATENT DOCUMENTS

| | | | | |
|---|---|---|---|---|
| 4,682,384 | A * | 7/1987 | Prahl | A47L 5/24 15/344 |
| 6,158,083 | A | 12/2000 | Holsten | |
| 6,530,116 | B2 * | 3/2003 | Berfield | A47L 5/14 15/326 |
| 2006/0127240 | A1 * | 6/2006 | Lee | A47L 5/22 417/366 |
| 2010/0162516 | A1 * | 7/2010 | Gierer | A47L 5/22 15/339 |
| 2015/0300369 | A1 * | 10/2015 | Sezal | F04D 17/122 415/1 |

* cited by examiner

*Primary Examiner* — Robert J Scruggs
(74) *Attorney, Agent, or Firm* — Armstrong Teasdale LLP

(57) ABSTRACT

A vacuum comprising a canister and a removable lid assembly that is configured to couple to the canister. The lid assembly includes a motor, an impeller coupled to the motor, a filter mounting structure configured to receive a filter element, and an impeller inlet with curved inner walls. These curved inner walls help to minimize air flow path disruptions.

20 Claims, 6 Drawing Sheets

EFFICIENT VACUUM CLEANER FAN INLET

CROSS REFERENCE TO RELATED APPLICATIONS

This application claims priority to U.S. Provisional Patent Application Ser. No. 62/062,434, filed Oct. 10, 2014, the contents of which are incorporated herein by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to vacuum cleaners; and more specifically relate to air impeller intake systems for vacuum cleaners.

Description of the Related Art

Wet/dry vacuums are capable of suctioning, (i.e., picking up) both wet and dry material, and typically comprise a collection tank or canister and a cover or lid in or upon which an air pressurization device is mounted. The air pressurization device is most usually an electric motor coupled to one or more fans. Typically, two airflow systems are established in a vacuum cleaner. The primary airflow system is configured to create the suction or vacuum used to entrain debris in the vacuum airflow and the second airflow system is configured to cool the electric motor. It is the primary airflow system to which the present invention is primarily applicable, and unless otherwise noted herein, the terms "airflow" and "airflow system" shall be intended to refer to the primary airflow used for vacuuming purposes.

In the primary airflow system, a rotating fan creates a pressure gradient that establishes airflow from high pressure to low pressure. Suction, or low pressure, is established within the canister by the rotating fan and debris can be suctioned into the canister through a canister air inlet. A filter system located typically within the canister prevents incoming debris from escaping from the canister or impacting the fan while allowing filtered air to be forcibly expelled through an air outlet, located typically in the lid.

A typical wet/dry vacuum motor and fan assembly comprises an AC motor coupled to a closed-face, multiple-blade impeller. The motor and fan assembly is typically disposed in a collection canister lid assembly, with the fan disposed within a chamber, sometimes referred to as a collector chamber. In some designs, the motor and fan assembly is detachable from the lid of the collection canister, allowing use as a hand-held blower for blowing dust and debris, such as in a workshop, outdoor area, or the like.

The inventions disclosed and taught herein relate to an impeller and airflow system that improves the suctioning performance of a vacuum cleaner.

BRIEF SUMMARY OF THE INVENTION

The objects described above and other advantages and features of the invention are incorporated in the application as set forth herein, and the associated appendices and drawings, related to systems for vacuum cleaners.

In accordance with a first embodiment of the present disclosure, a vacuum comprising a canister having a hose inlet and a removable lid assembly that is configured to couple to the canister. The lid assembly preferably includes a motor, an impeller coupled to the motor, an impeller inlet, and a filter mounting structure which may be configured to receive a filter element. The impeller inlet preferably has curved inner walls. These curved inner walls help to minimize air flow path disruptions.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
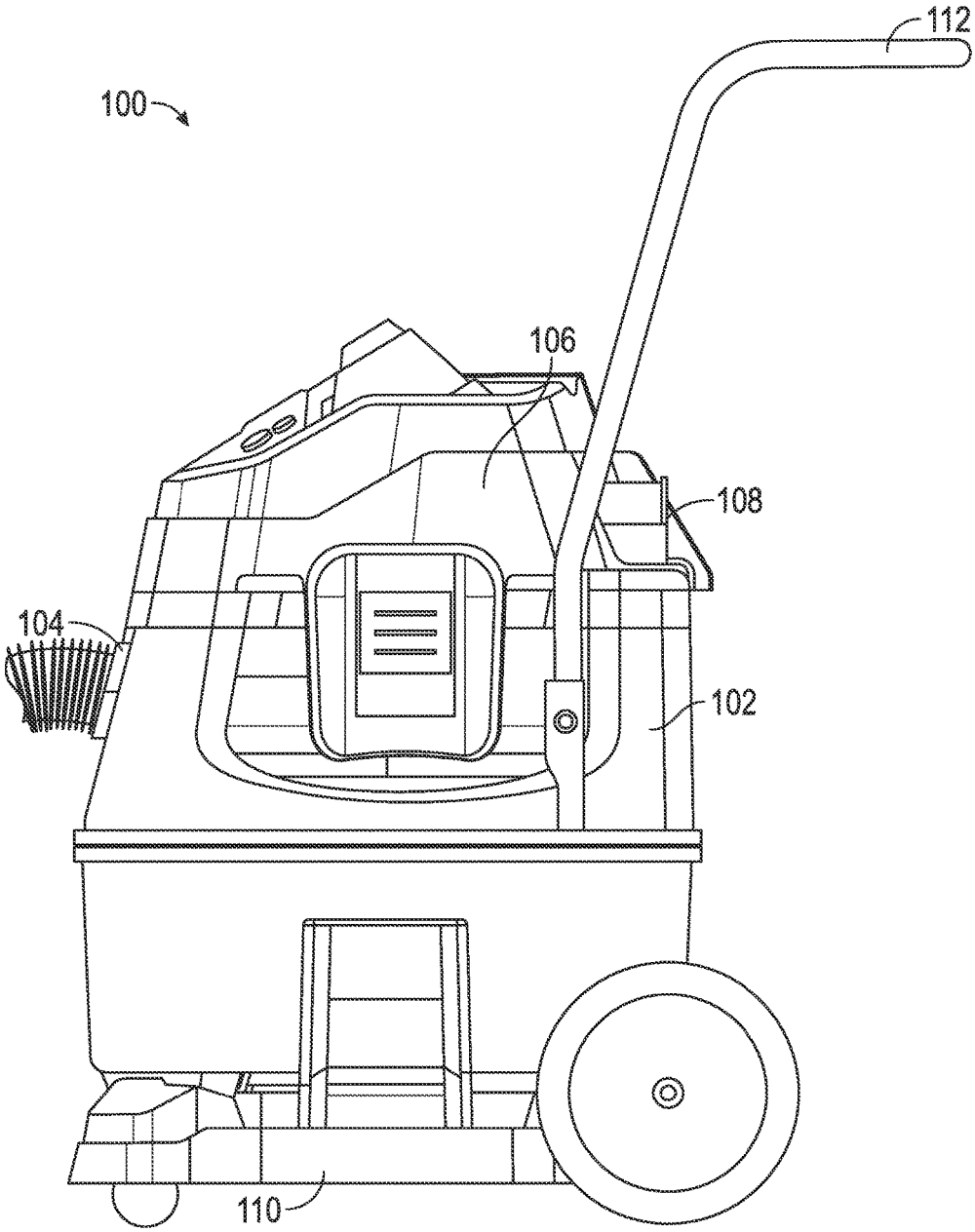
FIG. 1 illustrates a type of wet/dry vacuum cleaner that can benefit from the inventions disclosed herein.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what has been invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The following examples are included to demonstrate preferred embodiments of the inventions. It should be appreciated by those of skill in the art that the techniques disclosed in the examples which follow represent techniques discovered by the inventors to function well in the practice of the inventions, and thus can be considered to constitute preferred modes for its practice. However, those of skill in the art should, in light of the present disclosure, appreciate that many changes can be made in the specific embodiments which are disclosed and still obtain a like or similar result without departing from the scope of the inventions.

Applicants have created an improved impeller/air inlet assembly for a vacuum cleaner, such as, but not limited to, a wet/dry vacuum cleaner. According to the inventions herein, the air inlet to the impeller is configured to minimize air flow path disruptions to thereby maximize the pressure differential created across the air inlet and air outlet of the impeller. The air inlet is preferably configured to prevent abrupt changes in airflow direction, to minimize air flow eddys or stagnation and/or to smoothly transition the air flow from outside the inlet into the blade portion of the impeller. For example, and not for limitation, an airflow surface of an air inlet may be shaped to on a circular cross section having a constant radius, or a varying radius. Alternately, an airflow surface of an air inlet may be shaped to on an elliptical cross section.

Turning now to the figures, FIG. 1 illustrates a conventional wet/dry vacuum 100 comprising a canister 102 having an attachment or hose inlet 104. The vacuum 100 has a removable lid assembly 106 that comprises a pressurization device (not shown), filter (not shown) and air outlet 108. The particular vacuum 100 illustrated in FIG. 1 is attached to a wheeled caddy 110, and has a handle 112 for ease of portability.

Figure 2:
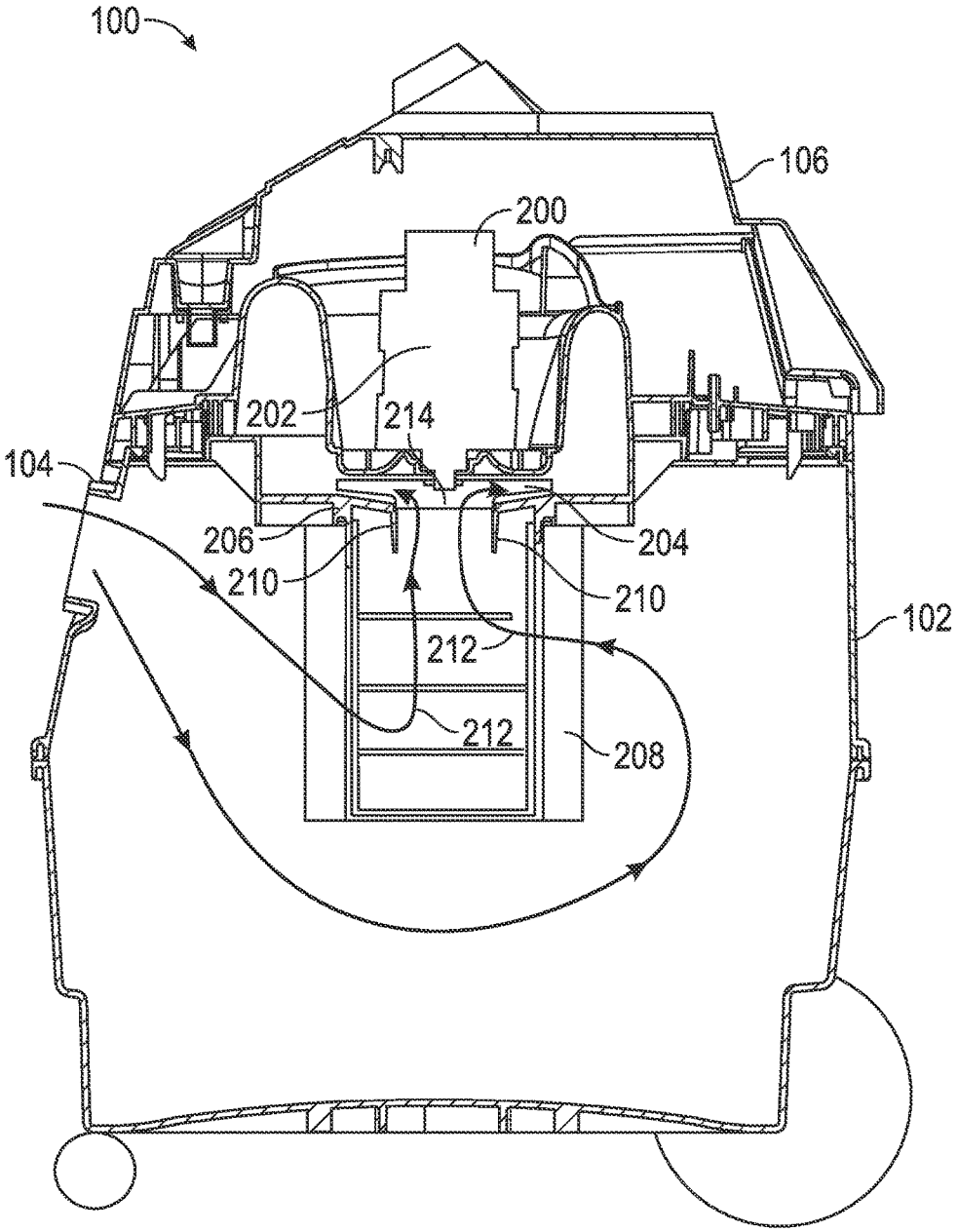
FIG. 2 illustrates a sectioned view of the vacuum cleaner in FIG. 1.

FIG. 2 illustrates a sectioned view of the vacuum 100 shown in FIG. 1. FIG. 2 illustrates that lid assembly 106 comprises an air pressurization device 200. The pressurization device of this embodiment comprises an electric an electric motor 202 and a closed-face impeller 204 coupled to the motor shaft. The lid 106 assembly comprises a filter mounting structure 206 to which a filter element 208 may be coupled and an impeller air flow inlet portion 210 or throat configured to direct filtered airflow 212 into the impeller inlet 214. The impeller air flow inlet 210 may be integral with the filter mounting structure 206, or the two may be separate structures.

It will be appreciated that as the motor 202 spins the impeller 204, an area of low pressure is created adjacent the impeller inlet 214. This area of lower pressure causes air outside of the canister 102, which is at, typically, atmospheric pressure, to flow through the inlet 104 into the canister 102, through the filter element 208, and ultimately out the exit 108. Debris, including solids and liquids, are entrained in the in-rushing air and collected in the canister 102 for later disposal.

Figure 3A:
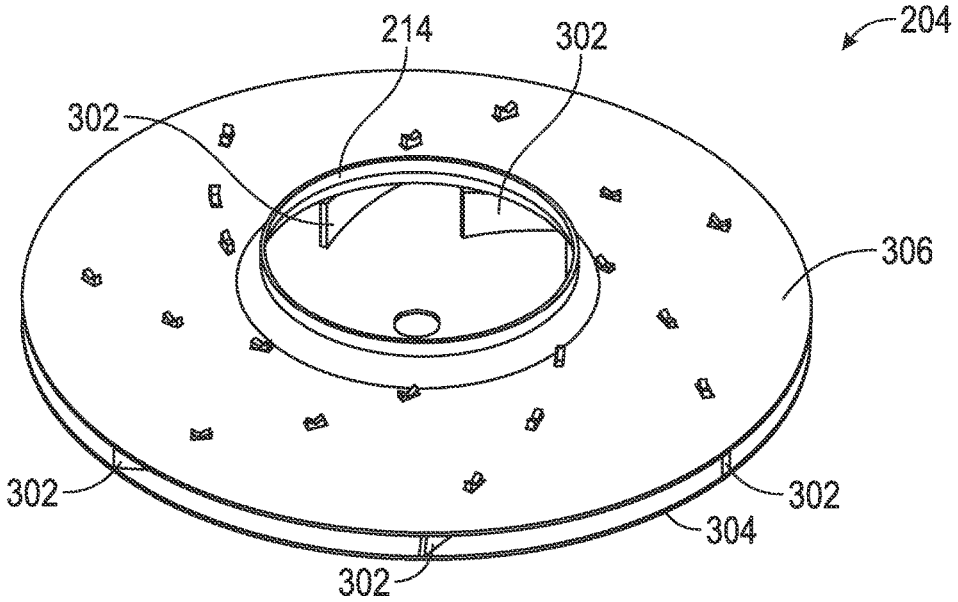
FIG. 3A illustrates a closed impeller of a type that may be used with the inventions disclosed herein.

FIG. 3A illustrates a typical impeller 204 for use in a wet/dry vacuum, such as vacuum 100. This type of impeller 204 will be referred to as a "closed-face" impeller because it has the vanes or blades 302 (see FIG. 3B) sandwiched between two plates or faces 304 and 306. Face 304 is configured to mate to the motor shaft. Plate 306 comprises impeller inlet 214 through which air is drawn when the impeller 204 is spinning.

Figure 3B:
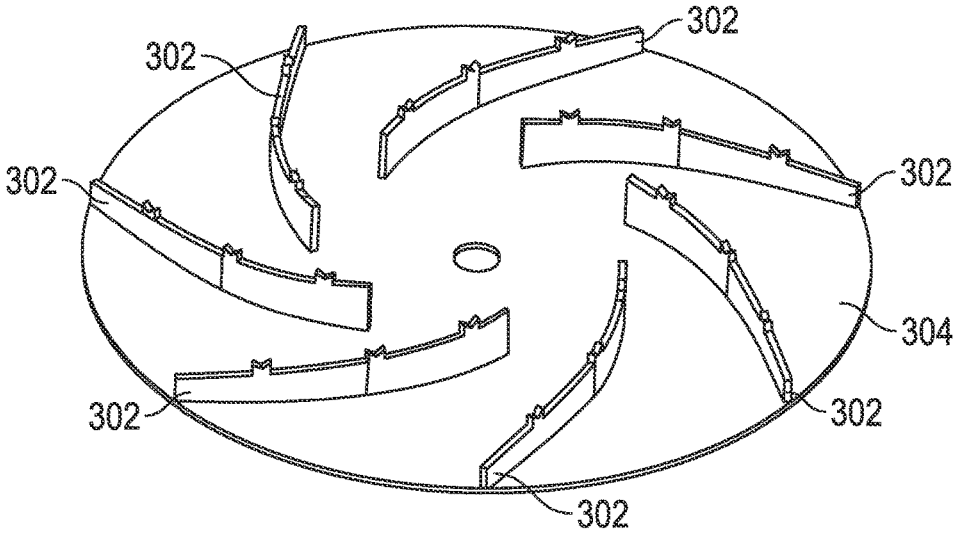
FIG. 3B illustrates the top plate of the impeller illustrated in FIG. 3A.

FIG. 3B illustrates the impeller 204 of FIG. 3A with the face 306 removed. FIG. 3B shows the arrangement of blades 302 and their curved or arcuate shape. It will be appreciated that fans suitable for use with the inventions described herein comprise closed or opened-face impellers having curved or straight vanes. It is preferred that the fan be a closed-face impeller as illustrated in FIGS. 3A and 3B. Such impeller 204 may be fabricated from metal, plastic or a composite material.

Figure 4A:
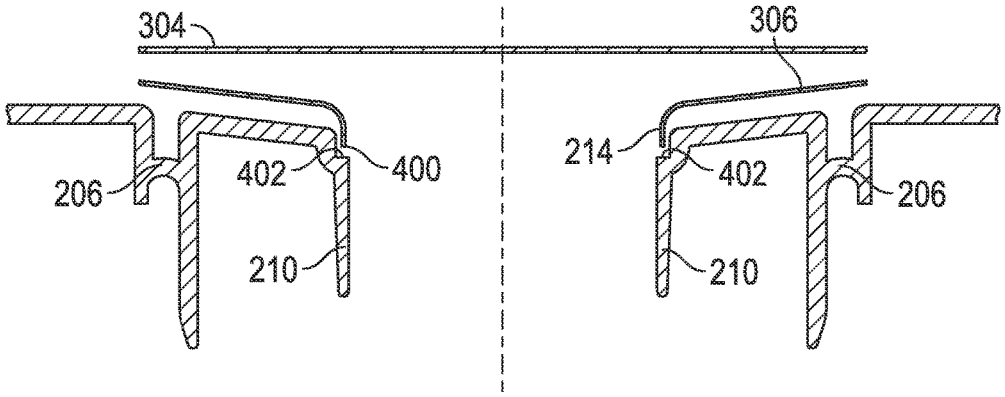
FIG. 4A illustrates a sectioned view of an impeller, such as the impeller illustrated in FIG. 3A, in functional position in the air inlet of a vacuum cleaner.

FIG. 4A illustrates a sectioned view of an impeller 204 positioned adjacent the impeller throat 210 that is typically formed in the vacuum lid 106. The terminal portion 400 of impeller inlet 214 is shown nested in a recessed area 402. Nesting the inlet 214 in this recess 402 creates a relatively smooth airflow transition between the lid inlet portion 210 and the impeller inlet portion 214. The lid inlet portion 210 comprises generally straight walls that are nearly, if not completely, perpendicular or normal to impeller plate 304.

Figure 4B:
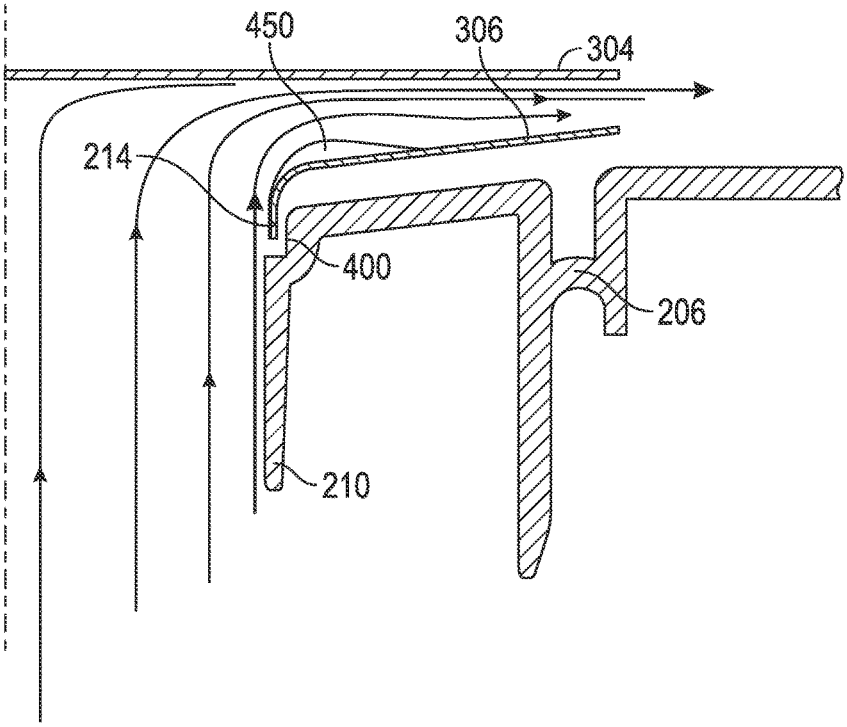
FIG. 4B illustrates airflow paths within the impeller/air inlet assembly illustrated in FIG. 4A.

FIG. 4B illustrates airflow, through use of anticipated airflow lines, through impeller 204 and inlet portion 210. These anticipated airflow lines have been magnified and simplified for clarity. As shown, the airflow through the impeller 204 is required to transition an approximately 90-degree change in flow direction. This abrupt change in direction tends to cause separation of the airflow from the inner surface of plate 306. This airflow separation or "drag" can cause a stagnation area 450 in the airstream, which can hinder airflow through the impeller and reduce performance. Areas of airflow separation, such as area 450 illustrated in FIG. 4B, typically exhibit eddy air flow currents, or air flowing in various directions, including counter flow, even though there is effectively or substantially zero net airflow along or adjacent the surface in this area 450.

Figure 5A:
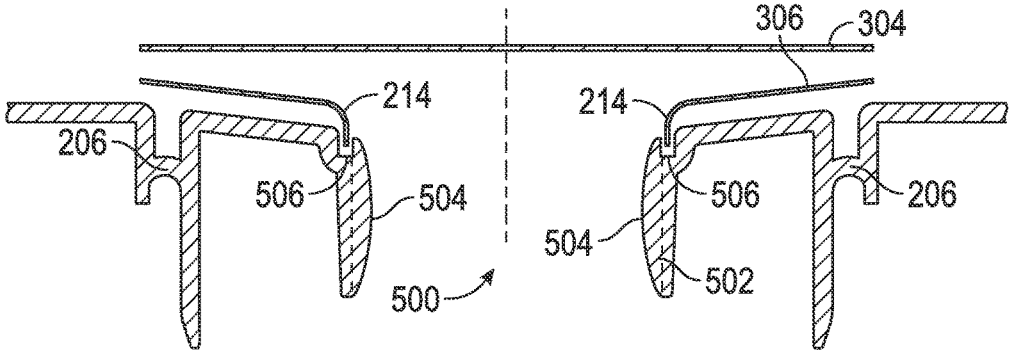
FIG. 5A illustrates an impeller/air inlet assembly according to the present invention.

FIG. 5A illustrates an improved fan inlet or throat 500. It will be immediately noted that the lid inlet portion 502 comprises wall 504 that is curved in convex fashion. The curvature of this wall shapes or directs the airflow toward the impeller plate 304 along plate 306 thereby reducing the approximately 90-degree transition angle of conventional vacuums. Reducing the transition angle reduces the tendency for airflow separation improving vacuum performance. Also shown in FIG. 5A, is a shrouded recess 506 in which the impeller inlet portion 214 is located. By shrouding this transition from the lid inlet 502 to the impeller inlet 214, disruption of the airflow is minimized and laminar air flow is maintained.

Figure 5B:
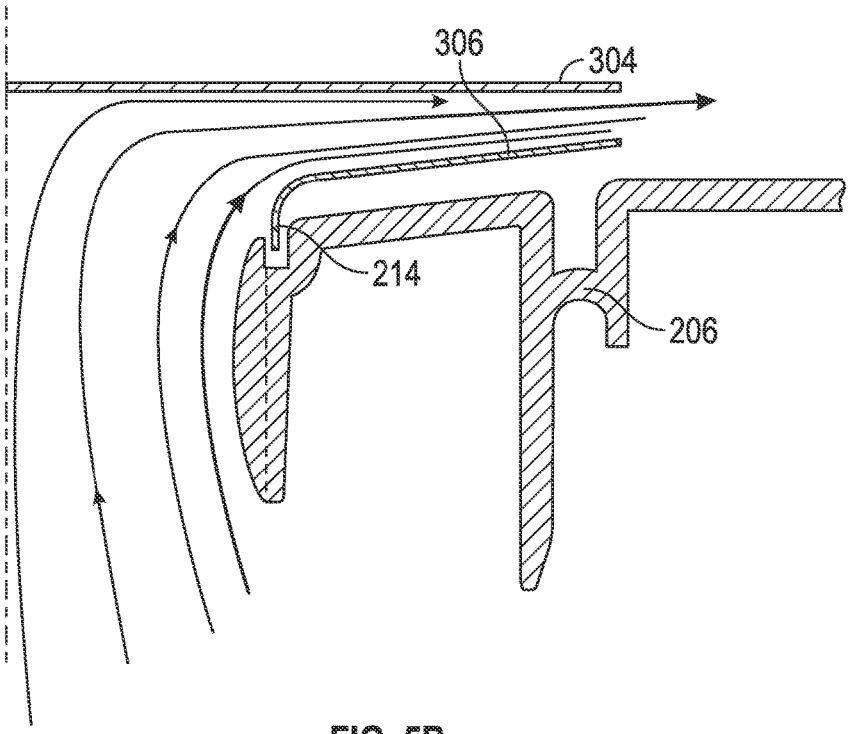
FIG. 5B illustrates airflow paths within the impeller/air inlet assembly illustrated in FIG. 5A.

FIG. 5B illustrates the anticipated airflow lines of the lid inlet/impeller assembly illustrated in FIG. 5A. As shown, the air flow more gently turns toward the impeller plate 306, as compared to the abrupt of direction change illustrated in FIG. 4B. This smoother transition reduces the tendency for the airflow to separate from impeller plate 306, as illustrated in FIG. 4B. The abrupt change in airflow direction of conventional impeller/air inlet systems is mediated and the airflow more curved toward the top plate 304 and, therefore, the transition angle to the general blower wheel airflow direction is reduced to less than an abrupt 90 degrees. This reduced transition angle reduces airflow separation within the impeller and increase vacuum performance.

Figure 6:
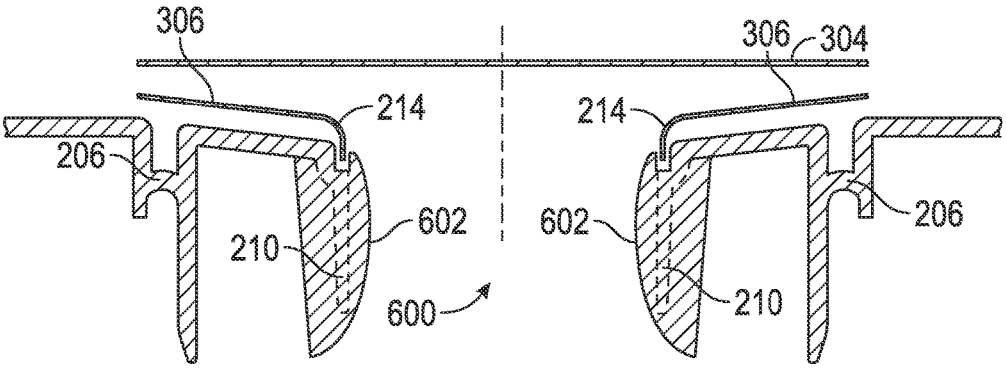
FIG. 6 illustrates another embodiment of an impeller/air inlet assembly according to the present invention.

FIG. 6 illustrates another air flow inlet 600 that shows the same basic curved walls 602, except that the curved walls 602 extend farther away from the blower wheel 204 to make a bigger inlet "lead-in" to help guide the inlet airflow into the impeller. Those of skill will appreciate the likely need to balance extending the air inlet walls against restricting airflow through the filter assembly (not shown).

Figure 7A:
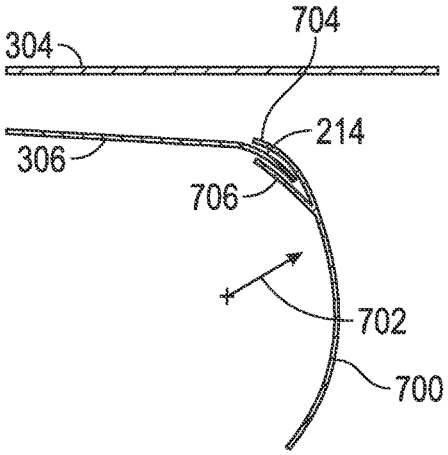
FIGS. 7A and 7B illustrate other embodiments of impeller/air inlet assemblies according to the present invention.
Figure 7B:
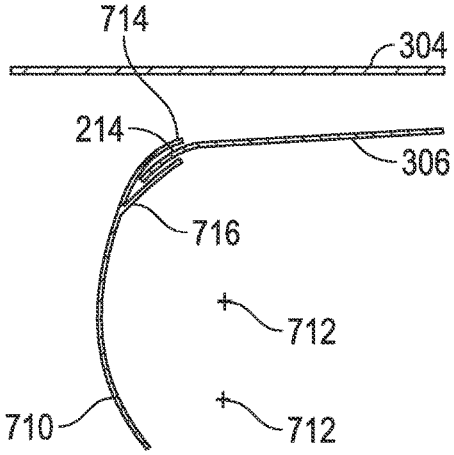

FIGS. 7A and 7B illustrates embodiments incorporating the inventions disclosed herein. For example, FIG. 7A illustrates an air inlet sidewall 700 having a basic circular cross section of radius 702, r. An upper portion of the air inlet 700 may have a first surface 704 that shields the impeller air inlet 214. As discussed, shielding this transition between the air inlet 700 and the impeller 204 reduces airflow path disturbances. Optionally, air inlet 700 may also include a second portion 706 that also shields the impeller inlet 214.

FIG. 7B illustrates an air inlet sidewall 710 having a basic elliptical cross section having foci 712. An upper portion of the air inlet 710 may have a first surface 714 that shields the impeller air inlet 214. As discussed, shielding this transition between the air inlet 710 and the impeller 204 reduces airflow path disturbances. Optionally, air inlet 710 may also include a second portion 716 that also shields the impeller inlet 214.

Thus, configuring the impeller/air inlet system to reduce, minimize or eliminate abrupt changes in the direction of the air flow will cause an increase in the performance of the vacuum cleaner. Increases in airflow system efficiency by approximately 1% can be achieved with the teachings of this disclosure.

Other and further embodiments utilizing one or more aspects of the inventions described above can be devised without departing from the spirit of Applicant's invention. The various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A vacuum cleaner comprising:

a canister having a hose inlet; and a removable lid assembly that is configured to couple to the canister, the lid assembly including— a motor, an impeller coupled to the motor, the impeller defining an impeller inlet, and an impeller throat with a curved inner wall upstream of the impeller inlet, wherein the impeller throat includes opposed vertical walls that define a shrouded recess, at least one of the opposed vertical walls extending upward along a radial inner side of the impeller inlet, the impeller inlet positioned within the shrouded recess, wherein the curved inner wall is convexly curved at a top of the inner wall to shape airflow entering the impeller.

2. The vacuum cleaner of claim 1, wherein at least a portion of the throat has a circular cross section.

3. The vacuum cleaner of claim 1, wherein at least a portion of the throat has an elliptical cross section.

4. The vacuum cleaner of claim 1, wherein at least a portion of the throat has a bezier curve cross section.

5. The vacuum cleaner of claim 1, wherein at least a portion of the throat has a quadratic bezier curve cross section.

6. The vacuum cleaner of claim 1, wherein at least a portion of the throat has a quadratic bezier curve cross section.

7. The vacuum cleaner of claim 1, wherein at least a portion of the throat is cylindrical.

8. The vacuum cleaner of claim 1, wherein at least a portion of the throat is conical.

9. A vacuum cleaner comprising:

a canister having a hose inlet; and a removable lid assembly that is configured to couple to the canister, the lid assembly including a motor, an impeller coupled to the motor, an impeller inlet with a curved inner wall, and an impeller throat with a curved inner wall, the curved inner wall convexly curved at a top of the inner wall to direct airflow entering the impeller, wherein the impeller throat includes opposed, upwardly-extending walls that define a shrouded recess, at least one of the upwardly-extending walls extending upward along a radial inner side of the impeller inlet, the impeller inlet positioned within the shrouded recess.

10. The vacuum cleaner of claim 9, wherein the inner wall of the throat is circular in horizontal cross section and arcuate in vertical cross section.

11. The vacuum cleaner of claim 9, wherein at least a portion of the inner wall of the impeller inlet has a circular cross section.

12. The vacuum cleaner of claim 9, wherein at least a portion of the inner wall of the impeller inlet has an elliptical cross section.

13. The vacuum cleaner of claim 9, wherein the inner wall of the impeller inlet has a circular cross section.

14. The vacuum cleaner of claim 9, wherein the inner wall of the impeller inlet has an elliptical cross section.

15. The vacuum cleaner of claim 9, wherein at least a portion of the inner wall of the impeller inlet has a bezier curve cross section.

16. The vacuum cleaner of claim 9, wherein at least a portion of the inner wall of the impeller inlet has a quadratic bezier curve cross section.

17. The vacuum cleaner of claim 9, wherein the inner wall of the impeller inlet has a bezier curve cross section.

18. The vacuum cleaner of claim 9, wherein the inner wall of the impeller inlet has a quadratic bezier curve cross section.

19. The vacuum cleaner of claim 9, wherein at least a portion of the impeller inlet is cylindrical.

20. The vacuum cleaner of claim 9, wherein at least a portion of the impeller inlet is conical.

* * * * *